US008366110B2

(12) United States Patent
Braun

(10) Patent No.: US 8,366,110 B2
(45) Date of Patent: Feb. 5, 2013

(54) GAME OF STRATEGY

(75) Inventor: Wilfried Braun, Mainz (DE)

(73) Assignee: Spielzeugdesign und Herstellung Wilfried Braun, Mainz (DE)

( * ) Notice: Subject to any disclaimer, the term of this patent is extended or adjusted under 35 U.S.C. 154(b) by 383 days.

(21) Appl. No.: 12/312,102

(22) PCT Filed: Oct. 22, 2007

(86) PCT No.: PCT/EP2007/061296

§ 371 (c)(1), (2), (4) Date: Mar. 8, 2010

(87) PCT Pub. No.: WO2008/049810

PCT Pub. Date: May 2, 2008

(65) Prior Publication Data

US 2010/0156046 A1 Jun. 24, 2010

(30) Foreign Application Priority Data

Oct. 26, 2006 (DE) ..... 10 2006 050 988

(51) Int. Cl.
*A63F 9/08* (2006.01)

(52) U.S. Cl. ..... 273/153 S; 273/155

(58) Field of Classification Search ..... 273/157 R, 273/153 S, 153 R, 155
See application file for complete search history.

(56) References Cited

U.S. PATENT DOCUMENTS

| | | | | | |
|---|---|---|---|---|---|
| 636,109 | A | * | 10/1899 | Bowers | 273/155 |
| D190,660 | S | * | 6/1961 | Mote | D21/480 |
| 3,655,194 | A | * | 4/1972 | Pierson | 273/153 S |
| 4,415,158 | A | * | 11/1983 | Engel | 273/153 S |
| 4,468,033 | A | * | 8/1984 | Minami et al. | 273/153 S |
| 4,550,040 | A | * | 10/1985 | Fisher | 273/153 S |
| 4,580,783 | A | * | 4/1986 | Cohan | 273/153 S |
| 4,735,417 | A | * | 4/1988 | Gould | 273/153 S |
| 4,978,126 | A | * | 12/1990 | Morosow et al. | 273/153 S |
| 5,135,225 | A | * | 8/1992 | Pszotka et al. | 273/153 S |
| 5,244,208 | A | * | 9/1993 | Kalapacs et al. | 273/153 S |
| 6,022,021 | A | * | 2/2000 | Ku | 273/153 S |
| 6,652,347 | B1 | * | 11/2003 | Stevkovski | 446/102 |
| 7,114,721 | B2 | * | 10/2006 | Micarelli | 273/242 |
| 7,309,064 | B1 | * | 12/2007 | Engel | 273/153 S |

FOREIGN PATENT DOCUMENTS

| | | | |
|---|---|---|---|
| DE | 3143735 | A1 | 5/1983 |
| DE | 3146801 | A1 | 6/1983 |
| DE | 8330957 | U1 | 5/1985 |
| DE | 69618241 | T2 | 8/2002 |
| GB | 2116050 | A | 9/1983 |
| GB | 2117256 | A | 10/1983 |
| WO | WO83/02239 | | 7/1983 |
| WO | WO96/30097 | | 10/1996 |

* cited by examiner

*Primary Examiner* — Steven Wong

(74) *Attorney, Agent, or Firm* — Michael L. Dunn

(57) ABSTRACT

A strategy game or game of patience having a playing surface (1) of higher complexity and with increased playing incentive. According to the invention to attain that object it is proposed that the playing surface (1) has a plurality of mutually overlapping circular surfaces (2, 3, 4, 5, 6) each of the same respective radius R, and with playing elements (7, 8, 21, 22) which are respectively arranged on at least one of the circular surfaces (2, 3, 4, 5, 6), wherein all playing elements (7, 8, 21, 22) which are disposed on any circular surface (2, 3, 4, 5, 6) belonging completely to the playing surface are rotatable jointly about the respective circle center point.

17 Claims, 9 Drawing Sheets

1
7
8 a
b
c
d
e
f
g
h
A
B
C
7"
7
8
13
14
15

GAME OF STRATEGY

BACKGROUND OF THE INVENTION

The present invention concerns a game of strategy with a playing surface.

Games of patience or strategy games of the most widely varying kind are known from the state of the art. What are referred to as sliding puzzles in which square or rectangular playing elements or tiles can be displaced relative to each other on a square or rectangular playing surface are widespread. In that case the sliding puzzles have so many playing elements that they completely cover the playing surface except for one field of the same size as a single playing element. The playing elements themselves are of such a configuration that they are displaceable relative to each other in two mutually perpendicular directions, wherein one playing element can be respectively displaced into the region of the playing surface which is just free and is not covered by any other playing element. Printed on the playing elements are motifs and patterns which can be broken down and assembled again or ordered, only by sliding the playing elements.

The sliding puzzles known from the state of the art suffer from the disadvantage that the possible combinations are limited by the restricted mobility of the individual playing elements on the playing surface and a single prefabricated game does not allow any possible variations.

In addition, known from the state of the art is a cube which comprises various colored cube portions which are rotatable relative to each other in segment-wise fashion about three independent spatial axes and which by virtue of rotation form colored patterns which are variable in many different ways, the aim of the game with that cube being to put a turned cube back into the initial position again, in which each side of the cube is of a uniform color in respect of the individual cube segments. However reliable solution algorithms have already long been developed for that purpose, which after a certain time take the attraction away from the game.

BRIEF SUMMARY OF THE INVENTION

In comparison with that state of the art the object of the present invention is to provide a strategy or game of patience of higher complexity and with an increased playing incentive.

That object is attained in that there is provided a strategy game having a playing surface, wherein the playing surface has a plurality of mutually overlapping circular surfaces each of the same respective radius R, and with playing elements which are movable with respect to the playing surface, wherein all playing elements which are disposed on any circular surface belonging completely to the playing surface are rotatable jointly about the respective center point of the circle.

DETAILED DESCRIPTION OF THE INVENTION

Figure 1:
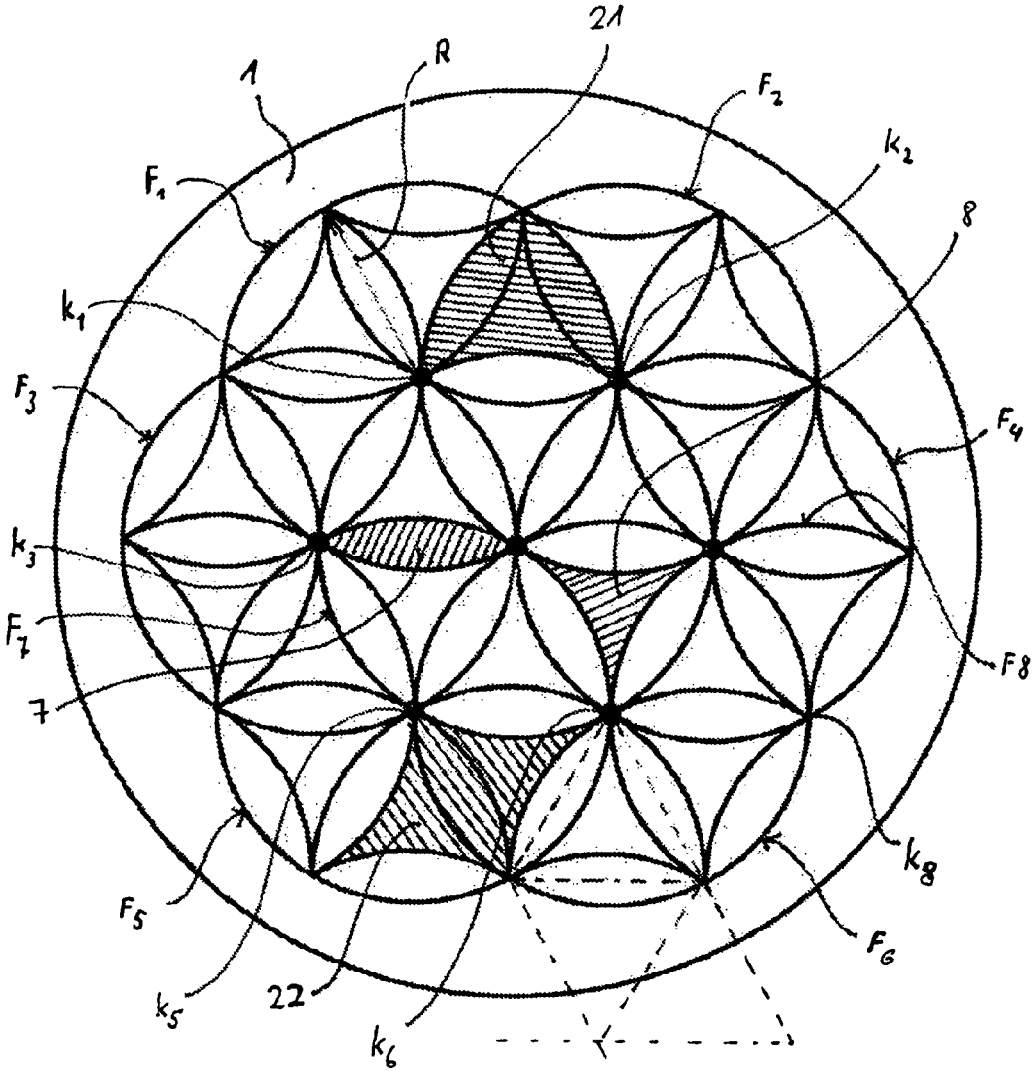
FIG. 1 diagrammatically shows a first embodiment of the strategy game according to the invention with seven mutually overlapping complete circular surfaces whose center points are arranged on the corners and the center of a regular hexagon.

Such an arrangement makes it possible for the playing elements to be moved by rotary movements around the center points of the circles over the playing area, wherein the playing elements disposed on the intersection surface of two circular surfaces are rotatable selectively about the one or the other circle center point. In that way the playing elements can be rotated out of the overlap region of the two circular surfaces and moved either into the region of the one of the circles, which region does not overlap with other circles, or into the region, overlapping with one or more other circles, of the circle about which the playing elements are rotated.

In that respect it is desirable if the playing elements substantially completely cover at least the parts of the circular surfaces which overlap with other circular surfaces. In that respect 'substantially completely' signifies that obviously small gaps or openings can remain even in relation to a surface which is otherwise completely covered by playing elements, by virtue of rounded configurations and tolerances or reduced dimensions which are deliberately provided at one side and which are intended to ensure mobility of the playing elements relative to each other. The complete coverage inter alia prevents playing elements from being displaced from their traditional placement on to other regions of the playing surface, in which they would possibly no longer be in a position suited to the symmetry of the rest of the arrangement of playing elements and possibly could also prevent unimpeded rotation of the other playing elements arranged on one or more of the circular surfaces.

In an embodiment the strategy game has at least one of the following playing elements: a first elementary element which is movable with respect to the playing surface and whose base surface is substantially defined by two mutually intersecting circular arc portions of identical radius R and the center point spacing of which is so selected that the intersection points of the circles coincide with adjacent corners of a regular N-gon, the corners of which lie on one of the circles, wherein the base surface forms the intersection quantity of the two circles, a second elementary element which is movable with respect to the playing surface and the outsides of which are formed by portions of at least three mutually touching or mutually intersecting circles and the base surface of which lies outside said circles, and a flat combination element which is movable with respect to the playing surface and the base surface of which is formed from the base surfaces of at least one first and at least one second elementary element. In that case the N-gon is preferably even-numbered.

It is possible in that way to implement design configurations for the strategy game, which have a differing degree of overlap, that is to say intersection surfaces of different sizes between the individual circular surfaces. In that case the number of corners also determines the symmetry of the arrangement of the circular surfaces on the playing surface.

In that respect embodiments which are particularly preferred are those in which the N-gon is a hexagon, an octagon or a decagon. In that respect the embodiment with a hexagon involves the highest level of symmetry, wherein all circular surfaces involved can have the same maximum overlap.

Particularly advantageous embodiments are those in which the first elementary element has exclusively convex outsides and the second elementary element has exclusively concave outsides.

A desirable embodiment of the invention is one in which the first elementary element has precisely two convex outsides and the second elementary element has at least 3 and in particular 3, 4 or 6 concave outsides.

A particularly preferred embodiment of the invention has at least one of the following playing elements movable relative to the playing surface:

an elementary element of a first type whose base surface is defined substantially by two mutually intersecting circular arc portions of substantially identical radius R, the center point spacing of which is $\sqrt{3}$ R, wherein R is the radius of the circular arc portions, an elementary element of a second type whose base surface is defined substantially by three mutually touching circular arc portions of identical radius R which are curved towards the center point of the elementary element and the center point spacing of which identically corresponds to double the radius R of the circular arc portions, a flat combination element which is movable with respect to the playing surface and whose base surface is formed from the base surfaces of at least one elementary element of the first type and at least one elementary element of the second type, wherein the playing surface has a plurality of mutually overlapping circular surfaces of respectively identical radius R and wherein all playing elements (elementary elements and combination elements) which are disposed completely on any one of the circular surfaces are rotatable jointly about the respective circle center point.

In that respect in particular an embodiment is advantageous, in which the game has at least two of the playing elements, for example an elementary element of the first type and a combination element which covers the remaining surface of a circular element.

That provides a strategy game which is distinguished by a high level of complexity which offers a high degree of playing incentive, and by a large number of playing variants. In addition the game according to the invention makes it possible to select or adjust the degree of difficulty of the game by the choice of the corresponding playing elements arranged on the playing surface.

The corner points of the above-defined elementary elements necessarily lie on the intersection points of circular arcs, wherein those intersection points respectively involve a spacing of R relative to each other. It will be noted however that for practical reasons the corner regions may additionally be somewhat shortened or rounded off in order for example to obtain a tolerance spacing between adjacent playing elements so that they can then be more easily movable relative to each other.

In that case the degree of difficulty of the game increases with an increasing number of elements on the playing surface and with the number of overlaps of circular surfaces.

The first and second elementary elements and the combination elements are summarisingly described as 'playing elements'.

Each of the circular surfaces on the playing surface is covered at least partially either only by elementary elements or by combination elements or combinations of the two. In that respect the surface of a circle of a radius R can be covered with the various elementary elements in such a way that the radially outwardly disposed boundaries of the radially outermost elements in the circle define the circumferential line of the circle of the radius R.

If in accordance with the invention two circular surfaces which are covered with playing elements in that way intersect, wherein the circle center points are preferably at a spacing from each other which is substantially equal to $\sqrt{3}\cdot R$ or which particularly preferably is substantially equal to the radius R the playing elements which expressed mathematically form the intersection quantity between the two circles can be alternatively and selectably rotated about the center point of a first circular surface or about the center point of a second circular surface. In that way the playing elements can be moved out of the surface of the first circle into the surface of the second circle and out of the intersection relationship. By virtue of the rotary movements about the center point of the circles on the playing surface, any playing element can be successively moved from one circular surface to another over the entire playing surface.

In the simplest embodiment all circular surfaces on the playing surface are covered by elementary elements. In that case, six first elementary elements are arranged on a circular surface in such a way that they extend in a star configuration from the center point of the circular surface to the circumferential line thereof. Six further first elementary elements connect the radially outer corner points of the first elementary elements arranged in a star configuration so that a closed circumferential line for the circle is formed by the outer boundaries of the base surfaces of the first elementary elements. Six second elementary elements are disposed between the first elementary elements so that the circular surface of a radius R is completely covered. The corner points of the first and second elementary elements, that is to say the intersection points of the circles defining their base surfaces, lie on a grid formed by equilateral triangles of radius R.

The size of the intersection relationship between the circles, that is to say also the number of playing elements interchangeable between the circles by rotary movement, is determined in dependence on the spacing of the center points of the individual circles from each other. If the spacing of the circle center points is $\sqrt{3}\cdot R$, only one elementary element of the first type can be moved from one circle into the other. If the spacing between the circle center points in comparison is substantially equal to the radius R of the circular surface, a maximum of seven elementary elements can be transferred by rotary movement from the first circular surface into the second circular surface. Of those seven elementary elements, five are elements of the first type and two are elements of the second type.

Variants in the game are afforded if coverage of the circular surfaces of the playing surface is effected with combination elements, instead of with individual elementary elements. Those combination elements represent any combinations of the elementary elements of the first and second type, whose concave and convex boundaries respectively of the base surfaces are fixedly connected together. In that respect a one-piece embodiment of the combination elements is preferred, as a combination of the elementary elements of the first and second types. The use of larger combination elements makes it possible to limit the number of possible combinations of moves in the game, which are afforded by rotation of the individual circles, so that it is possible to set game configurations involving a differing degree of difficulty.

In that respect, if the playing surface is of a sufficient size, combinations of elementary elements and all conceivable forms of elementary elements can cover the playing surface.

In that respect desirable embodiments are in particular those in which a combination element is provided for the purpose of limiting the number of circular surfaces which are available on the playing surface and which are involved in the game. It is possible in that way to vary the degree of difficulty of a game involving a predetermined playing surface as, depending on the respective task involved, the degree of difficulty of the game decreases or increases with a decreasing number of the circular surfaces involved. In that respect it is particularly advantageous if the combination element which reduces the number of circular surfaces participating in the game is of such a configuration that it precisely embraces the playing elements of a circular surface which are outside the intersections with adjacent circular surfaces. In that case the combination element preferably blocks a rotary movement about the center point of the circular surface which is to be 'removed' from the game.

In a preferred embodiment both the playing surface and also the individual playing elements are made from wood, preferably plywood. Alternative embodiments however can also have a playing surface and/or playing elements of metal, plastic material, stone or cardboard.

To permit a circular movement of the playing elements about the center point of the circular surfaces without the individual elements becoming hookingly engaged with each other the claimed, exactly described form of the individual playing elements is only approximately implemented in preferred embodiments and in particular the corners of the elements, formed by the intersection lines of the circles defining the base surfaces, are rounded off. Therefore the surface coverage of the individual circular surfaces with playing elements is preferably not entirely complete and, in regard to such deviations from the theoretical ideal shape, the shapes of the individual elements are described as being 'substantially' given both in the claims and also in the description.

By virtue of the described geometry of the first elementary elements it is desirable if the playing elements are rotatable about the respective circle center point at least through an integral multiple of $$\frac{\pi}{3}(=60^\circ).$$

It will be noted however that it would be conceivable, even if relatively complicated, to also permit rotary movements through less than 60°, for example through 30°, as a move in the game, in which case then however the first and second elementary elements would have to be still further divided up, without thereby modifying the basic idea of the strategy game. A rotation through at least 60° as the simplest move which permits subsequent rotation also of adjacent circles and transfer of playing elements from the overlap region into the other circle is therefore preferred.

In a particularly preferred embodiment the playing surface has retaining elements which respectively secure the playing elements in a position rotated through 60° or a multiple thereof, in metastable fashion. In a particularly preferred embodiment for that purpose the playing elements have magnetic or ferromagnetic elements which releasably fix the playing elements to the playing surface. In that case the magnetic or ferromagnetic elements are preferably so arranged that the playing elements are rotatable alternatively and selectably about the center points of a first or a second circular surface. That prevents the playing elements from dropping off the playing surface for example in the event of a shock to the playing surface.

In that respect a preferred embodiment of the invention is one in which the magnetic or ferromagnetic elements are arranged on the playing surface in such a way that they permit rotation of the playing elements on a circular surface in a six-fold symmetry, that is to say there are provided in the rotary direction six discrete positions at which at least one playing element can be releasably fixed. Preferably the magnetic or ferromagnetic elements are so arranged that the playing elements are fixed at least at the positions which correspond to the six-fold axis of symmetry and at which at least a part of the playing elements are movable selectively by rotation about the circle center point of a first circular surface or a second circular surface.

In a particularly preferred embodiment on the side remote from their playing surface the playing elements have at least one pin provided for movement of the elements with respect to the playing surface. In that way the user of the game can grip the playing elements which are preferably of a flat configuration at the pin and rotate them about the center point of the circular surfaces.

As an alternative to rotation of the playing elements by hand, a preferred embodiment is one which has a circular disk, preferably of a radius R, and with an axis member through the center point thereof, wherein the axis member is so designed that it engages releasably into a hole in the center point of one of the circular surfaces into the playing surface so that the disk is rotatable about the center point of the circular surface and wherein the disk has entrainment means such as for example openings into which complementary entrainment means such as for example the pins of the elementary elements and/or the combination elements releasably engage so that the elementary elements and/or the combination elements which lie within the first or the second circle are rotatable jointly with respect to the playing surface by means of the disk.

In that respect it is particularly desirable if more than one playing element has the pins according to the invention so that the disk drives more than one playing element simultaneously and directly or indirectly all playing elements lying within the circle engaged by the disk. Alternatively the disk can have pins engaging into corresponding openings in the playing elements.

By virtue of using the disk for driving the playing elements on the playing surface there is no need to provide guides, grooves, ribs or tracks in the playing surface. The absence of guides, grooves or ribs on the playing elements in turn makes it possible for them to be of a transparent configuration in one embodiment, without having to tolerate disturbing light refraction effects.

In addition the disk makes it possible for the game to be implemented, without adverse effect on function, even when the playing surface is not completely filled up with playing elements.

In an embodiment therefore the playing elements do not have any connections at all, such as for example grooves and ribs, with each other. In other words, the playing elements have a top surface and a rear surface and side surfaces connecting the top surface and the rear surface, the side surfaces being formed by surfaces extending perpendicularly to the top and rear surfaces. Mutually adjoining playing elements therefore do not have any mutually overlapping portions in a view from above. In that way the playing elements can be removed from the playing surface and interchanged at any time and without involving assembly complication and effort. In addition the omission of guides such as grooves and ribs on the playing elements affords the possibility of increasing the size of the playing surface almost as desired. In comparison games which involve a connection or guide between the playing elements are limited to a small number of mutually overlapping circles by virtue of the required tolerances which are added to each other.

A particularly preferred embodiment of the invention is one in which the playing surface has at least one part-circular guide, preferably of a radius R, so that the playing elements are movable guidedly in an opening in the playing surface with an inside radius R.

In that respect, in an embodiment, the playing surface within the part-circular guide is flat and smooth so that it can be easily lacquered, printed upon or coated. It is further possible in that way for the playing surface to be covered on the part of the players with different films which show the pattern to be attained. To achieve a flat smooth playing surface the retaining elements, in particular the magnetic or ferromagnetic elements, are let into the playing surface in such a way that they terminate flush with the top surface thereof or are arranged in concealed relationship under the top surface of the playing surface.

Alternatively the guide can also be in the form of guide slots in the playing surface, in which mushroom-shaped guide pins provided on the playing elements engage.

In the simplest form the playing surface is a flat surface on which any number of circular surfaces in at least partially mutually overlapping relationship is provided. However alternatively embodiments of the invention are also possible, in which the playing surface is a curved surface, preferably the surface of a sphere.

In a preferred embodiment in that respect the surface of the sphere is designed in the nature of a football formed from pentagons and hexagons. By virtue of the six-fold symmetry thereof the circular surfaces of the playing surface can be arranged on the hexagons and substantially cover them. In comparison the pentagons remain free and can serve for receiving supports which carry the sphere or however for fixing a transparent cover in the form of a portion of a sphere. An advantageous variant of such a sphere comprises 12 pentagons and 30 hexagons with which, in the planar development, there are associated central circles on a 'triangular lattice' with the center point spacing of $\sqrt{3}$ R, wherein disposed in the center of each three adjacent hexagons is a further circle which overlaps with the other circles and which involves a center point spacing R relative thereto. That corresponds to 40 overlapping circular surfaces on the basis of the geometry of a dodecahedron from which the corners have been removed and which corresponds to the manner of division of a standard football. In alternative embodiments the sphere has 12 such pentagons and 20 hexagons or 12 pentagons and 60 hexagons.

With an identical sphere diameter and an arrangement involving 12 pentagons, the degree of difficulty can be modified to a considerable degree by virtue of the choice of the number of hexagons and suitable adaptation of the size of the playing tiles and the rotary disk.

In a preferred embodiment at least one of the playing elements is identified by a color so that colored patterns of various kinds can be formed and broken down again by rotation of the playing elements about the circle center points.

A preferred variant of the color identification of the playing elements is afforded if the entire surface formed by the playing elements on the playing surface and optionally the immovable edge of the playing surface are printed upon with a pattern or motif. Then the aim of the game, after the motif has been jumbled, is to order it or restore it again only by rotary movements of the playing elements on the circular surfaces.

Alternatively or additionally the playing elements can have a preferred direction, for example by an arrow painted thereon. In that way the complexity of the game can be further increased as now the individual playing elements have to be arranged not only in accordance with their color but also in accordance with their orientation.

In further variants of the game the playing elements are uniquely and distinguishably identified, for example by numbers or letters. It is possible in that way to formulate further playing aims such as for example arranging the elementary elements of the first type which form the periphery of a circular surface and which are numbered consecutively, in the reverse sequence.

Further alternative configurations of the strategy game according to the invention are afforded if the playing surface or parts thereof and at least one of the playing elements are colored, wherein at least the playing element is transparent. In that case the patterns can be configured by subtractive color mixing as between the movable playing elements and the stationary playing surface which is preferably colored differently in various regions.

Further possible variants are afforded for example by the use of a transparent material for the playing surface and at least one of the playing elements, wherein both the playing surface and also the playing elements have regions which have light-polarising properties, for example by coating with a polarisation film.

A desirable embodiment of the invention is one in which at least the contours of the elementary elements are represented on the circular surfaces of the playing surface.

In a further embodiment the playing surface has a preferably removable transparent cover, for example of Plexiglas. That on the one hand prevents playing elements from dropping out during transport of the game while on the other hand it prevents direct access on the part of the players to the playing elements during the game in order to prevent 'cheating'. It is desirable in particular for such an embodiment if the disk for rotating the playing elements comes into interaction therewith by means of magnets. It is advantageous in that respect if the disk has stronger magnets than the fixing of the playing elements to the playing surface. In that way the playing elements, in the rotary movement, are slightly lifted off the playing surface and can be rotated under the transparent cover.

As an alternative to the configuration in the form of a representational board game having a playing surface and playing elements of wood, plastic material, glass, ceramic, metal, stone or the like the strategy game according to the invention can also be embodied as a computer game, in which case the playing surface and the playing elements are projectable on to the monitor of a computer. In that case the rotary movements of the playing elements on the circular surfaces can be implemented by means of a mouse, a keyboard or a touch-sensitive display (touch screen).

The means for representing the playing surface, the playing elements and the rotary movements thereof can in that case be implemented as software.

In a first embodiment the computer game is implemented on a personal computer, wherein such implementation is possible on all known operating systems.

In a preferred embodiment the computer game is a game for a preferably portable games console, for example a GAMEBOY handheld gaming device.

In addition the protection of the present invention is intended also to embrace any kind of data carrier on which the software for representing the playing surface of the playing elements and the movements thereof is stored or implemented.

Further features, advantages and possible uses of the present invention will be apparent from the description hereinafter of preferred embodiments and the accompanying Figures.

FIG. 1 diagrammatically shows a first embodiment of the strategy game according to the invention with a playing surface 1 which has seven circular, mutually overlapping circular surfaces F1, F2, F3, F4, F5, F6 and F7 of identical radius R, wherein the center points of the circles F1 through F6 are arranged on the corners of a regular hexagon and the seventh circle F7 has its center point in the center of the hexagon. In this case the circles F1 through F7 are of a radius corresponding to the side length of the hexagon. Accordingly therefore all circle center points lie on a triangular lattice formed from equilateral triangles. In that respect in the illustrated embodiment the playing surface 1 comprises a wood panel in which the circular surfaces F1 through F7 are let in the form of recesses. In this respect in the illustrated embodiment all circular surfaces F1 through F7 are covered by first elementary elements 7 and second elementary elements 8 or by combination elements 21, 22.

The base surfaces of the first elementary elements 7 are defined by two mutually intersecting circular arc portions of radius R which is equal to the radius R of the circular surfaces 2 through 6, the spacing between the intersection points of the circular arc portions forming the corners of the first elementary element being equal to the radius R of the circular arc portions. The second elementary elements 7 have a base surface defined by three mutually touching circular arc portions which are curved towards the center point of the elementary element, with a substantially identical radius R, wherein the spacing between the intersection points of the circular arc portions forming the corners of the base surface of the second elementary elements 8 is equal to the radius R of the circular arc portions. In that way each of the circular surfaces F1 through F7 is covered by a maximum of ten elementary elements of the first type 7 and six elementary elements of the second type 8.

In that case the center points k1 through k7 of the circular surfaces F1 through F7 involve different spacings from each other. As they are disposed on a lattice formed from equilateral triangles, all most closely adjacent circle center points involve the spacing R, R simultaneously being the radius of the circles and the length of the elementary side of the triangular lattice. Those circles overlap with around 39.1% of the circular surface. The next-but-one adjacent circles are of a center point spacing of $\sqrt{3}$ R and respectively overlap only by about 5.77%. In that case the intersection quantity or relationship of two circles at the spacing $\sqrt{3}$ R just respectively forms a first elementary element. The spacing between the center points of the third-next adjacent circles is double the radius R of the individual circular surfaces. Those third-next circles no longer overlap but respectively touch each other at only one point, wherein the circumferential lines between the contact points of three circles with a center point spacing of 2R (which are disposed on the corners of an equilateral triangle of the side length 2R) define the contours of the second elementary element. While therefore the circular surfaces which are at a spacing from each other which is equal to twice the radius R do not have an intersection relationship, the circles with a center point spacing of $\sqrt{3}\cdot R$ have an intersection relationship which is precisely as large as an elementary element 7 of the first type. In contrast circles with a center point spacing equal to R have an intersection relationship in which there are contained five elementary elements 7 of the first type and two elementary elements 8 of the second type. The corresponding number of elementary elements in the respective intersection relationship can be transferred by rotary movement of the elementary elements on one of the mutually intersecting circular surfaces F1 through F7 from the mutually overlapping surfaces entirely or optionally also only partially into only one of the circular surfaces.

In FIG. 1 the corresponding elementary elements 7, 8, the circles F1 through F8 producing them and also some combination elements 21, 22 are partially illustrated by hatchings. The hatched first element 7 is afforded for example as the intersection quantity or relationship of the two mutually overlapping circles F1 and F5 whose center points k1 and k5 are at the spacing $\sqrt{3}$ R. The hatched second elementary element 8 is produced as the remaining surface area between the contact points of the three circles F2, F5 and F8 (wherein only a part of the latter forms a part of the playing surface, namely the part which also overlaps with the circles F4 and F6). The corresponding center points k2, k5 and k8 are on the corners of an equilateral triangle of the side length 2R. Further circles from which it is possible theoretically to generate all elementary elements of the playing surface by overlapping are disposed on the triangular lattice indicated in broken line, which in principle can be enlarged as desired, just as the playing surface can be enlarged as desired by further circular surfaces which should have at least a slight overlap with each other in accordance with the first elementary element.

Two of a plurality of further possible combination elements 21, 22 composed from elementary elements 7, 8 are also emphasised by hatching.

Figure 2:
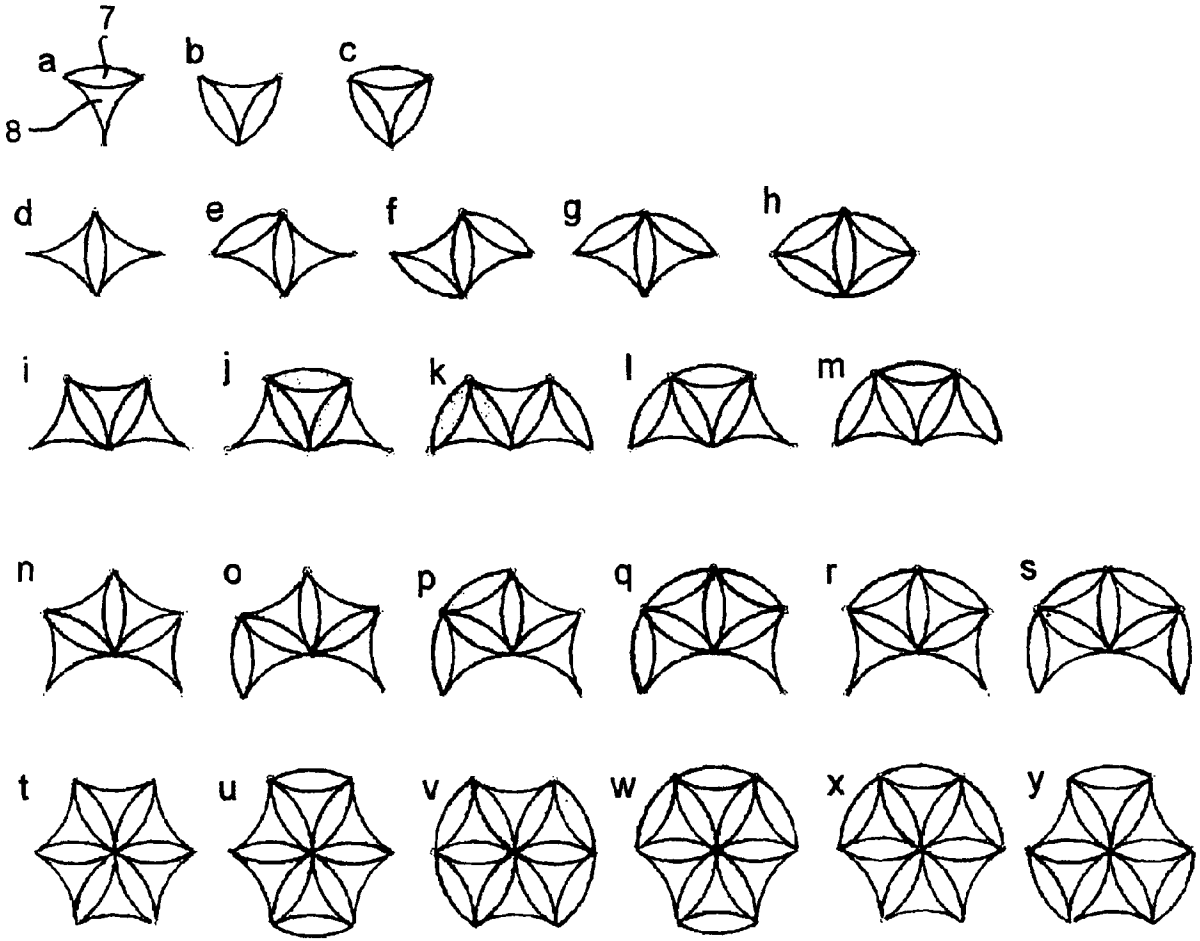
FIGS. 2*a* through *y* show possible combination elements consisting of the two elementary elements.

Instead of all circular surfaces being covered with first and second elementary elements 7, 8, a plurality of mutually juxtaposed elementary elements 7, 8 can be respectively replaced by what are referred to as combination elements which are respectively composed of one or more elements of the first and second type. A large part of the possible combination elements (insofar as they do not exceed the limits of a circular surface) are shown in FIGS. 2*a* through 2*y*. By way of example the combination element shown in FIG. 2*a* is composed of a first elementary element 7 and a second elementary element 8, wherein the elementary elements are connected together at the curved contours of radius R, forming the boundaries of their base surfaces. FIGS. 2*a* through 2*y* only show a diagrammatic representation. The combination elements of FIGS. 2*a* through 2*y* are desirably made in one piece from the geometrical shapes of the first and second elementary elements 7, 8. In that respect however the outlines of the individual elementary elements 7, 8, as can be seen from FIGS. 2*a* through 2*y*, are printed on the combination elements. Alternatively or additionally thereto the surfaces of the elementary elements can be differently colored on the combination elements, that in turn affording further playing configurations. In other embodiments the combination elements are colored in one color.

Those combination elements can each replace a respective corresponding number of elementary elements on a circular surface. In dependence on the size of the combination elements, they can either be interchanged in accordance with the elementary elements between the individual circular surfaces by rotary movements or, like for example the combination elements shown in FIGS. 2*i* through 2*y*, they are restricted to being rotated about a single circle center point without being interchangeable between a plurality of circular surfaces.

Figures 3, 4, 5, 6, 7, 8:
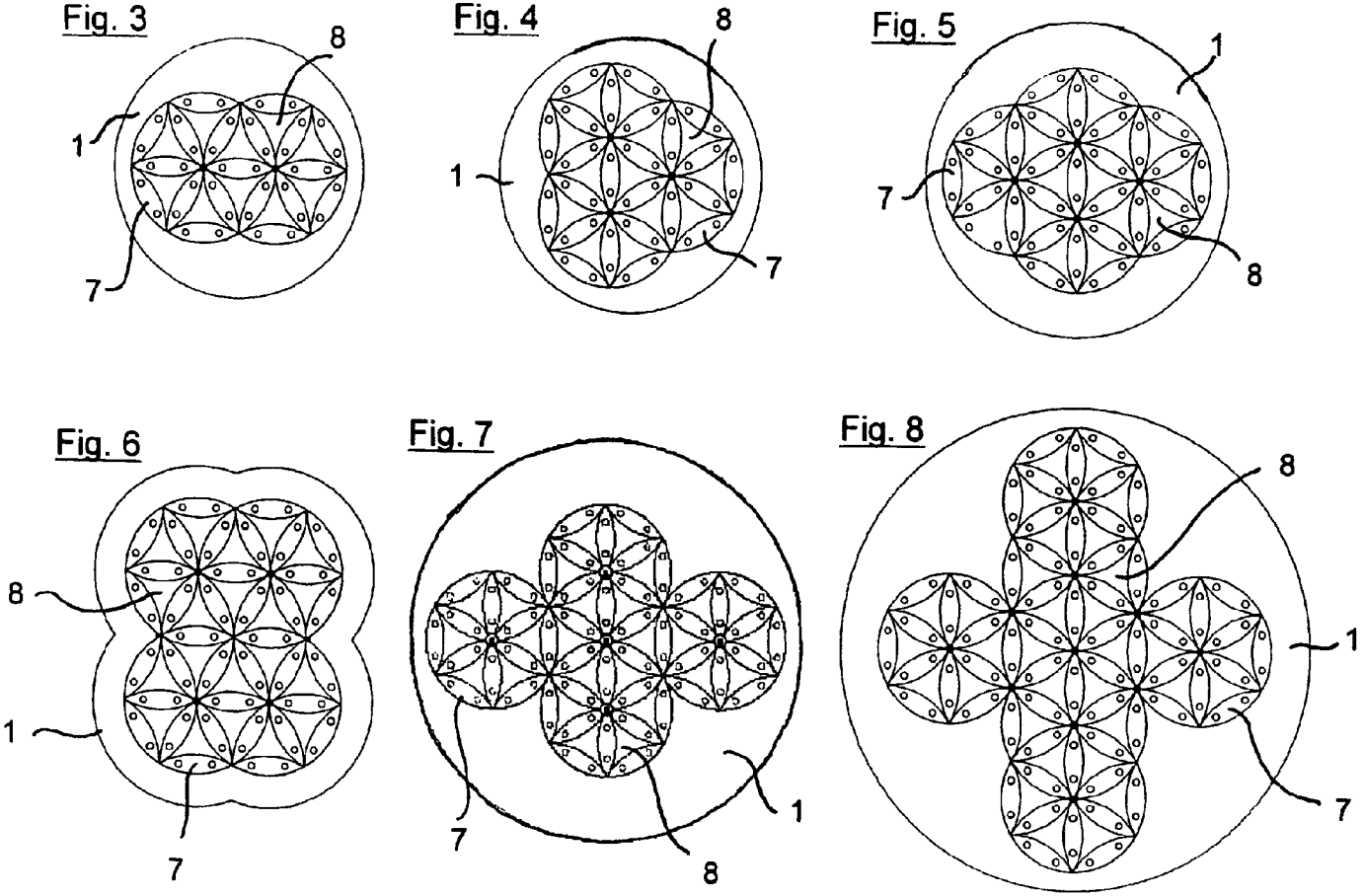
FIG. 3 shows an embodiment with two circular surfaces.
FIG. 4 shows an embodiment with three circular surfaces.
FIG. 5 shows an embodiment with four circular surfaces
FIG. 6 shows an embodiment with five circular surfaces arranged as a rectangle.
FIG. 7 shows an embodiment with five circular surfaces.
FIG. 8 shows an embodiment with seven circular surfaces forming a cross.
Figure 11:
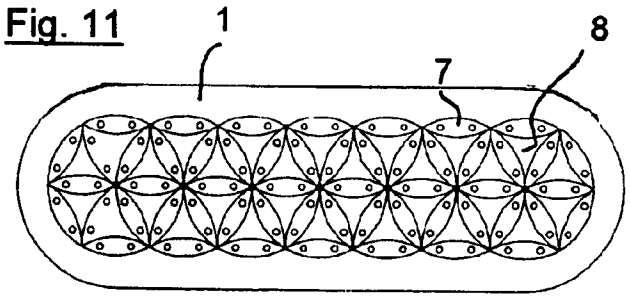
FIG. 11 shows an embodiment with seven circular surfaces arranged in a row.
Figure 10:
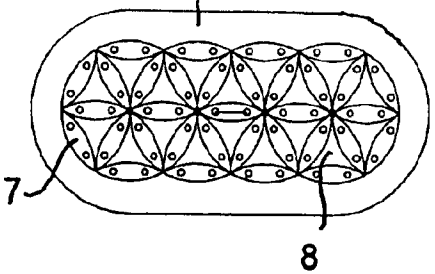
FIG. 10 shows an embodiment with four circular surfaces arranged in a row.
Figure 9:
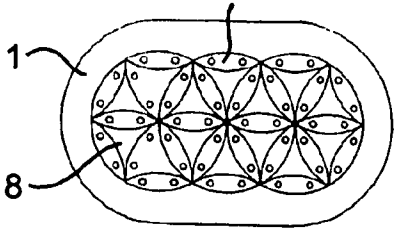
FIG. 9 shows an embodiment with three circular surfaces arranged in a row.
Figure 13:
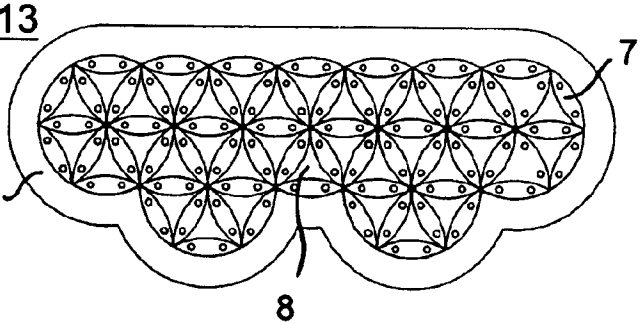
FIG. 13 shows an embodiment with nine circular surfaces.

The combination element of FIG. 2*m* is used in particular to reduce the number of circular surfaces provided on a predetermined playing area, for a variant of the game. If for example as in the embodiment of FIG. 4 three circular surfaces overlap, it is possible to use the element of FIG. 2*m* in such a way that it replaces the elementary elements of one of the circular surfaces in a region which does not form an intersection relationship with one of the other circular surfaces. The active playing surface is reduced thereby.

FIGS. 3 through 14 show to an extensive degree the same elementary structure of mutually overlapping circular surfaces as was shown by means of the first embodiment of FIG. 1. All illustrated embodiments have mutually overlapping circular surfaces on which there are arranged elementary elements 7, 8 movable about the respective circle center point. The rotary movement of the elements on the respective circular surfaces provides that the elements can be interchanged between the individual circles and altered in their position on the playing surface 1. In this respect, identical elements are denoted by the same references in the illustrated Figures. The elementary elements shown in FIGS. 3 through 14 can also be partially replaced in alternative embodiments by one or more combination elements as shown in FIGS. 2*a* through *y*.

It will be seen from FIGS. 3 through 14 that in the illustrated embodiment the first elementary elements 7 have magnets 12 with which the elementary elements can be releasably fixed on the playing surface 1 at corresponding ferromagnetic elements arranged in the circular surfaces 2 through 6, in the illustrated embodiment being nails.

Figure 12:
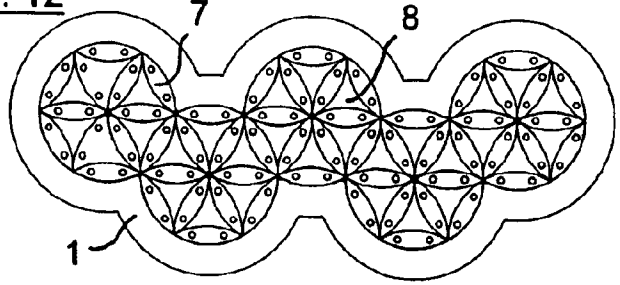
FIG. 12 shows an embodiment with five circular surfaces arranged in the manner of the Olympic rings.
Figure 14:
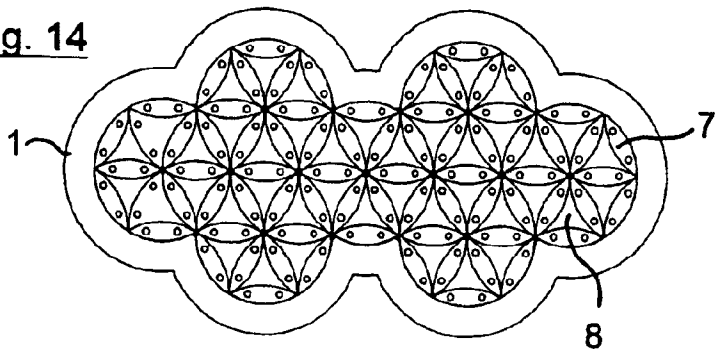
FIG. 14 shows an embodiment with eleven circular surfaces.

FIG. 12 shows an arrangement with five circular surfaces forming the Olympic rings. As in this embodiment the mutually juxtaposed circular surfaces all have a center point spacing of $\sqrt{3}$ R, only elementary elements of the first type are interchangeable by rotary movements between the circular surfaces. In this embodiment therefore the individual elementary elements arranged around the center point of the circular surfaces can be replaced by a combination element as shown in FIG. 12*t*).

Figure 15:
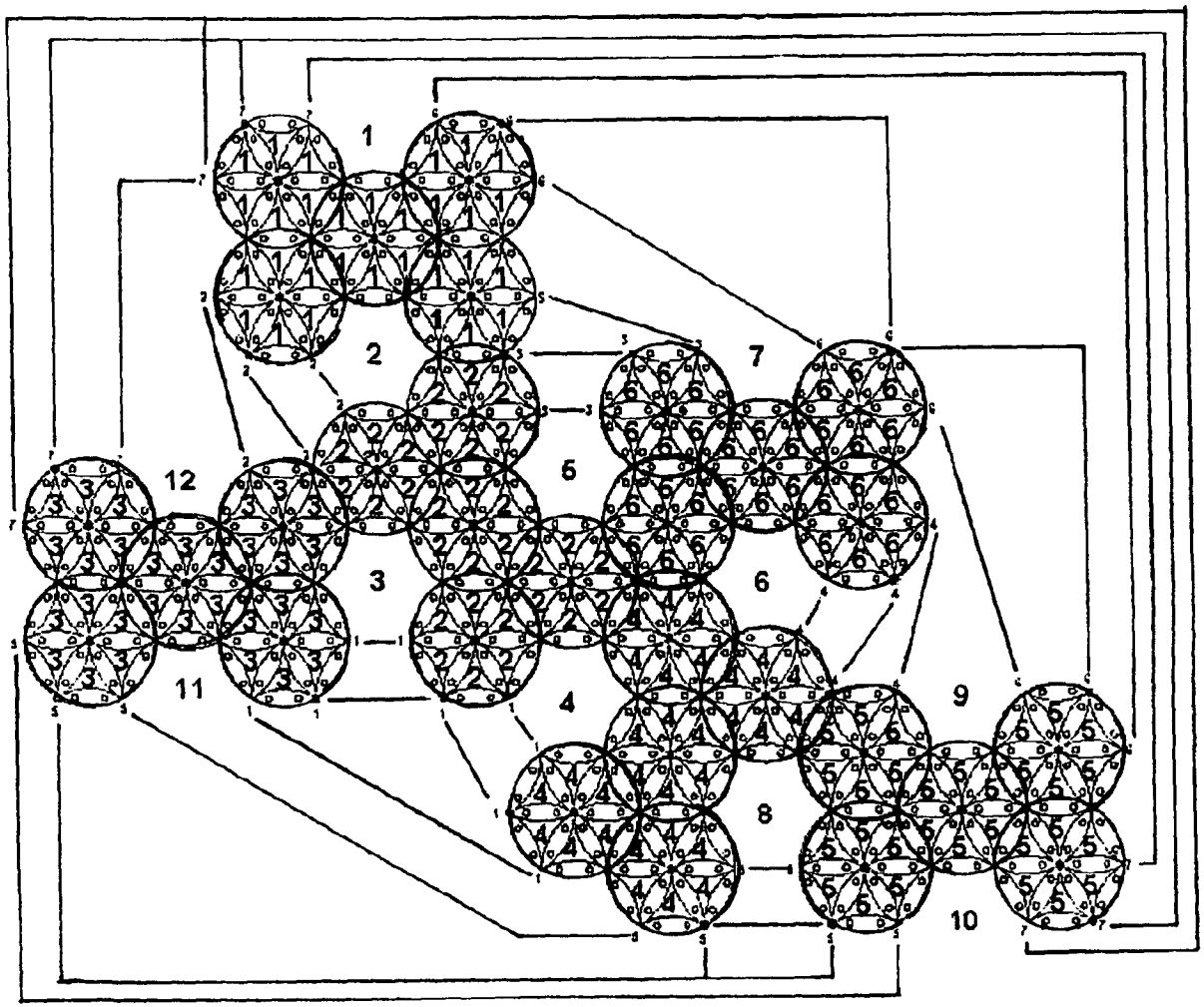
FIG. 15 shows the planar development of an embodiment with a spherical surface.

FIG. 15 diagrammatically shows the development of the circular surfaces according to the invention of a playing surface in the form of a spherical configuration. In this case points connected by straight lines and with the same digit identification meet each other at the same point when the individual circular surfaces are arranged on the surface of the sphere. In contrast to the above-described playing elements with a flat base surface the illustrated elementary elements 7', 8' have curved base surfaces representing portions of spheres. The illustrated sphere, in the manner of a football, comprises 12 pentagons and 30 hexagons. In this case all hexagons are covered with mutually overlapping circular surfaces. For an embodiment with a curved surface, the operating disk for rotation of the playing elements on the playing surface is also curved.

While only the arrangement in principle of playing elements on playing surfaces of differing configurations was respectively illustrated by reference to the above-described FIGS. 16*a* through 16*h* show by way of example a first possible game in the form of individual steps. The playing surface 1, corresponding to the FIG. 4 embodiment, has three circular surfaces 13 through 15 with center points A, B and C respectively. All circular surfaces are covered in surface-coverage relationship with first elementary elements 7 and second elementary elements 8. The elementary elements 7" forming the circumference of the circular surface 15 with the center point C have a directional orientation which in the illustrated embodiment is predetermined by a glued-on arrow. In this case the arrows point the elementary elements 7" in the clockwise direction in the starting position shown in FIG. 16*a*. The aim is now to alter the elements 7" of the circular element 15 only by rotary movements of the individual circular surfaces 13 through 15 about the center points A through C, in such a way that the elementary elements 7" are so arranged on the circular surface 15 that the arrows point in the counter-clockwise direction. For that purpose firstly the elementary elements are rotated on the circular surface 14 in the clockwise direction about the center point B of the circular surface 14 through two positions, that is to say twice 60°. That gives the arrangement shown in FIG. 16*b*. An arrangement as shown in FIG. 16*c* is reached by rotation of the playing elements on the circular surface 15 by one position (60°) in the counter-clockwise direction. The circular surface 14 is now rotated in the clockwise direction through one position (60°), thus giving the arrangement shown in FIG. 16*d*. That is then followed by a rotary movement of the elements on the circular surface 15 about the center point C through two positions (twice 60°) in the counter-clockwise direction to give an arrangement as shown in FIG. 16*e*. In the next step the elements on the circular surface 14 are rotated about the center point B through two positions (twice 60°) in the clockwise direction, giving the arrangement shown in FIG. 16*f*. That is followed by rotation of the elements on the circular surface 15 about the center point C through one position (60°) in the counter-clockwise direction to give an arrangement as shown in FIG. 16*g*. Finally the elements on the circular surface 14 are now rotated about the center point B through two positions (twice 60°) in the clockwise direction so that the target arrangement of FIG. 16*h* is reached, in which all elementary elements 7" on the circular surface 15 enjoy an orientation in the counter-clockwise direction.

As can be seen from the description this game variation could also be played on a playing surface with only two circular elements having a center point spacing which is equal to the radius of the circular surfaces.

Figure 16:
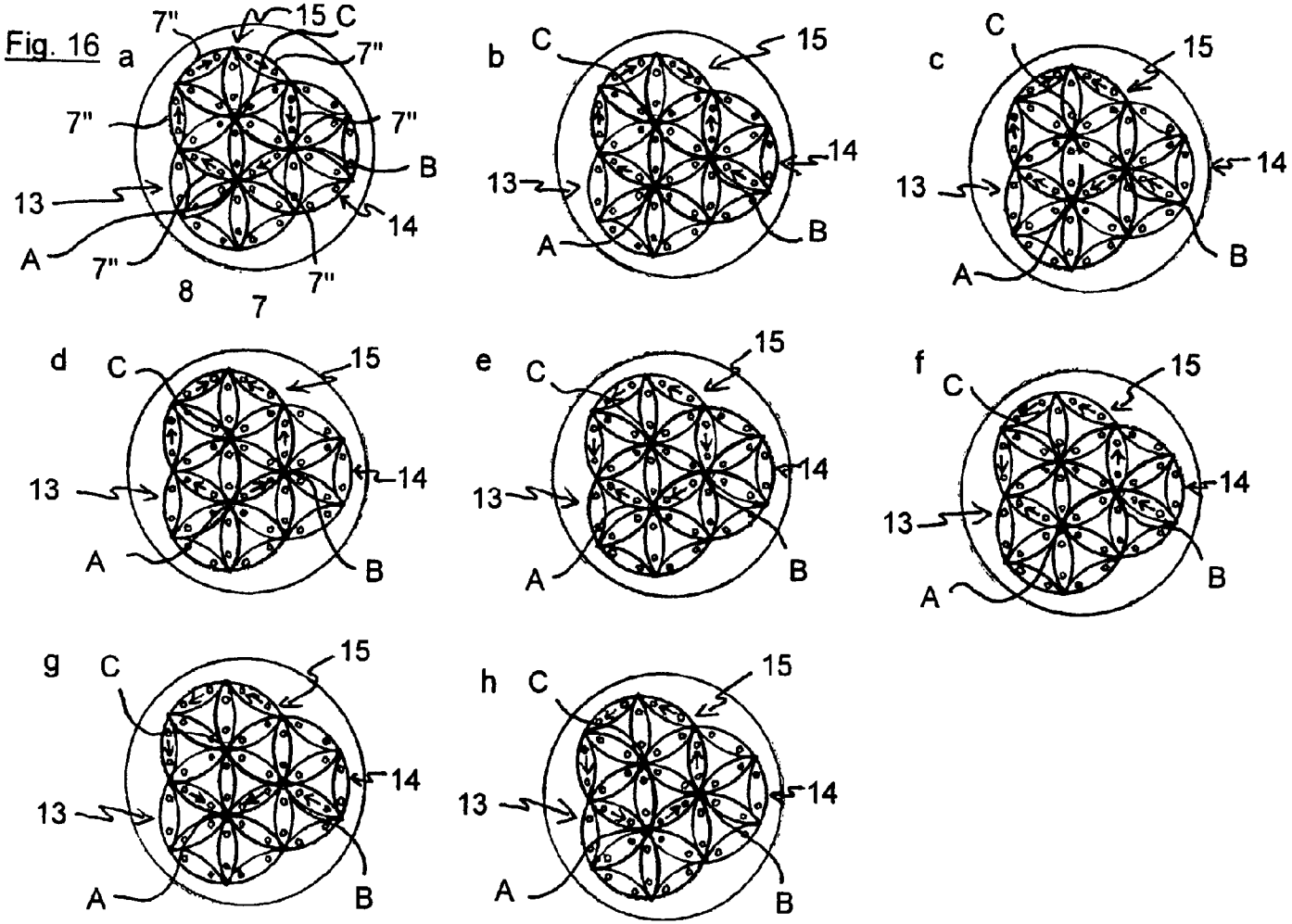
FIGS. 16*a* through *h* show a first variant of the game with an embodiment with three circular surfaces as shown in FIG. 4, FIGS. 17*a* through *c* show a second variant of the game with three circular surfaces as shown in FIG. 4.
Figure 17:
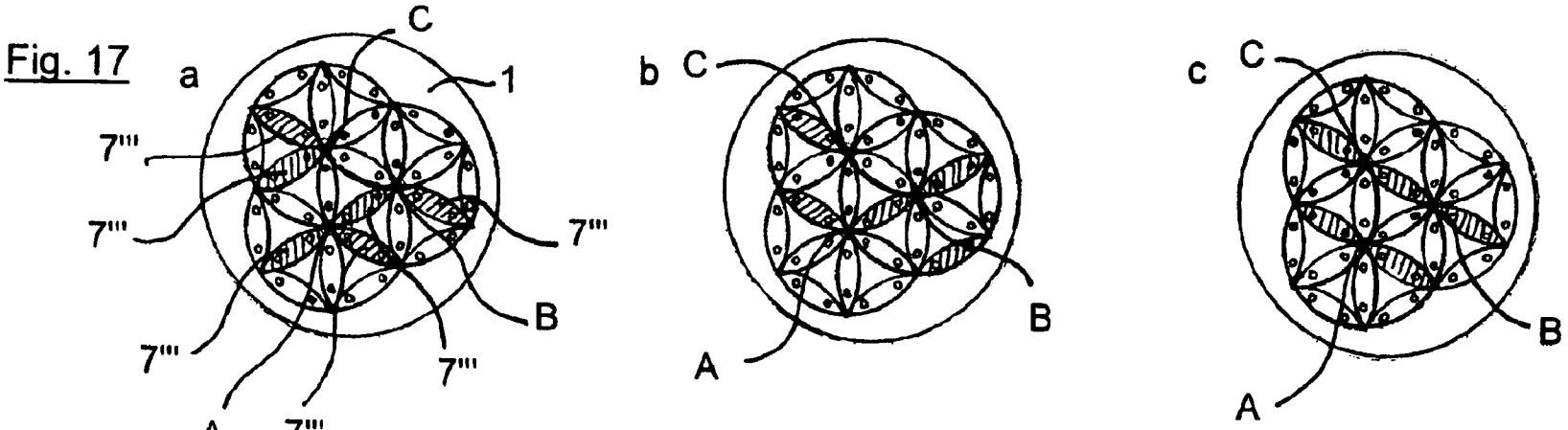

The playing surface 1 known from FIG. 16 however allows still further game variants. For example FIG. 17 shows an embodiment of the game in which the six elementary elements 7" identified by arrows are replaced by color-marked elements which are not distinguished in terms of their directional orientation. An aim of the game can be for example, starting from an arrangement as shown in FIG. 17*a*, to reach two substantially mutually parallel lines of elementary elements 7'" by rotary movements about the center points A, B, C of the mutually overlapping circular surfaces 13, 14, 15. The following steps are required for that purpose:

17*a*→17*b* rotation about A through one position (60°) in the clockwise direction.

17*b*→17*c* rotation about B through one position (60°) in the clockwise direction.

In that respect for example the game shown in FIG. 16 can also be played as a party game, wherein two or more players begin a game with a free playing surface and a respective number of playing elements. Each player is given a task, for example producing a closed ring with six identically colored elementary elements of the first type. The players now alternately place their playing elements on the circular surfaces of the playing surface in accordance with strategic points of view until the playing surface is completely covered with playing elements. Then, by alternate rotation of the elementary elements on the circular surfaces, the players try to achieve the set task. The player who can first complete the ring of his color has won.

Figure 18:
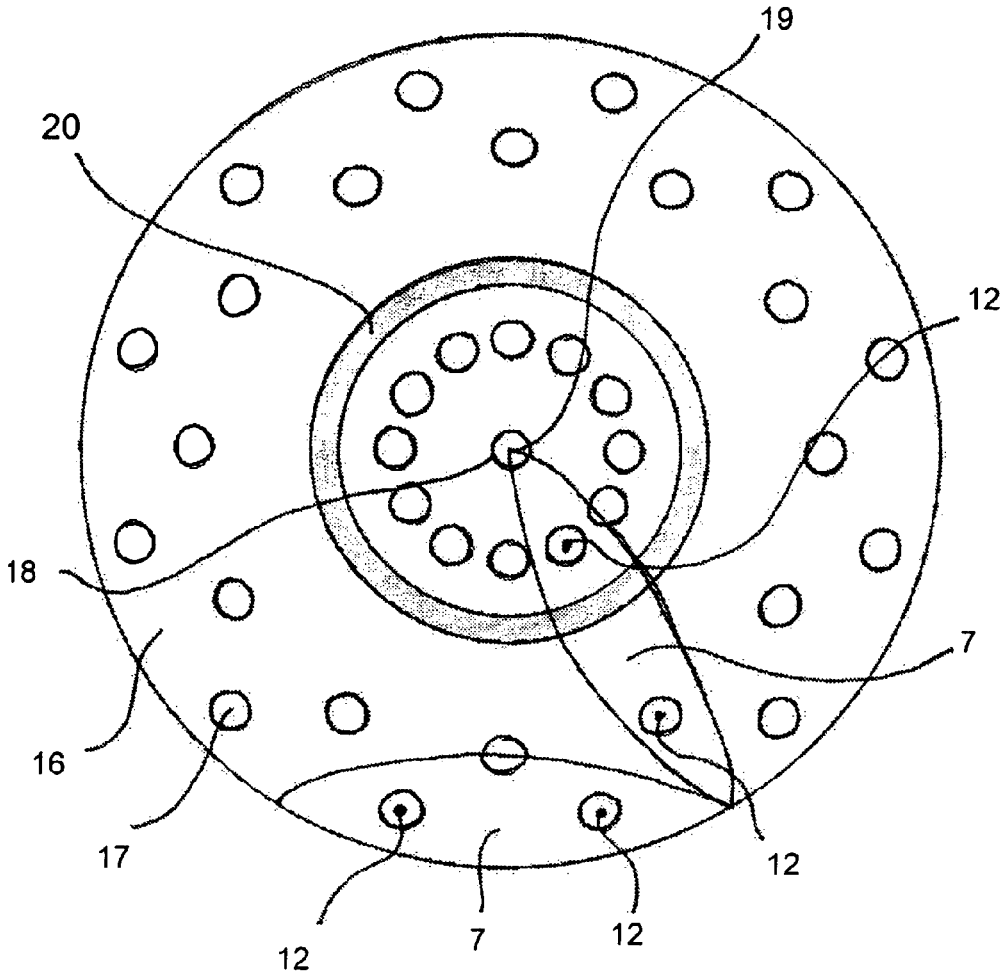
FIG. 18 shows an embodiment of a disk for rotation of the playing elements.

FIG. 18 shows an embodiment of a disk 16 for performing the rotary movement of the individual playing elements 7, 8 about the center points of the respective circular surfaces. In the illustrated embodiment the disk 16 is made from plastic material and it has bores 17 arranged in a regular pattern in the disk. The pins 12 which project upwardly out of the playing elements engage through the bores while the axis member 18 arranged at the center of the disk 16 engages into an opening in the center point of a circular surface of the playing surface. FIG. 18 shows by way of example two elementary elements 7 on the circular surface. FIG. 18 shows how the pins 12 of the elementary elements 7 engage through the openings 17 through the disk 16 so that the elementary elements 7 can be rotated about the center point 19 by means of the disk. In the illustrated embodiment the disk only has bores 17 for pins 12 of the first elementary elements 7 while the second elementary elements 8 arranged between the first elementary elements 7 are moved driven by the movement of the first elementary elements 7. In other embodiments however further bores can be provided in the disk, through which pins of the second elementary elements 8 engage. In order to make the disk better to grip for the player, it has a thick ring 20 of plastic material which projects upwardly with respect to the disk 16 and which can be gripped by the player with the fingers of a hand. In order also to permit the player a view on to the playing elements while performing a rotary movement the disk 16 in the illustrated embodiment is made from Plexiglas. Transparent disks of other materials however are also conceivable.

Figure 19:
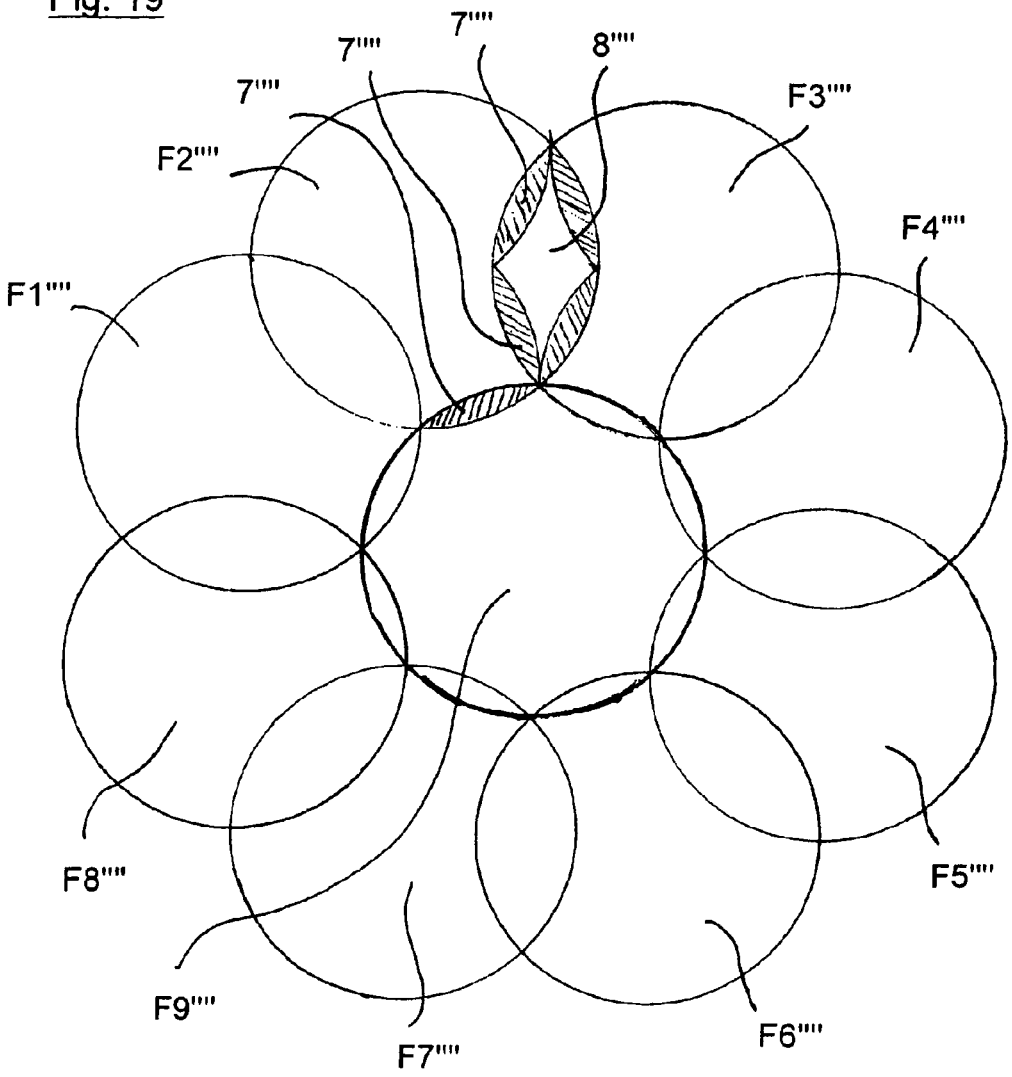
FIG. 19 shows an alternative embodiment with nine circular surfaces.

In the embodiment shown in FIG. 19 the circular surfaces F1"" through F9"" of radius R are so arranged that the displaceable playing elements 7"", 8"" on the circular surfaces or the arrangement thereof involve an eight-fold axis of symmetry. The playing elements can be rotated in steps each of 45° about the center points of the circular surfaces F1"" through F9"". The first elementary elements are formed by two mutually intersecting circular surfaces of the same radius R and with a center point spacing of approximately 1.85 R.

In this arrangement the circular surfaces are at different spacings from each other and therefore also have intersection surfaces of differing sizes. The circular surfaces F1"" through F8"" arranged around the central circular surface F9"" respectively form with the central circular surface F9"" an intersection surface with a single elementary element 7"". In this case the circular surfaces F1"" through F8"" have a respective center point spacing of approximately 1.85 R with respect to the circular surface F9"". In contrast thereto the circular surfaces F1"" through F8"" arranged around the central circular surface F9"" have an intersection surface which respectively contains four elementary elements 7"" and a further elementary element 8"". In this case the circular surfaces F1"" through F8"" have a center point spacing of about 1.4 R from each other.

For the purposes of the original disclosure it is pointed out that all features as can be seen by a man skilled in the art from the present description, the drawings and the claims, even if they are described in specific terms only in connection with certain other features, can be combined both individually and also in any combinations with others of the features or groups of features disclosed here insofar as that has not been expressly excluded or technical aspects make such combinations impossible or meaningless. A comprehensive explicit representation of all conceivable combinations of features is dispensed with here only for the sake of brevity and readability of the description.

LIST OF REFERENCES

1 playing surface
2, 3, 4, 5, 6 circular surfaces
7, 7', 7", 7"', 7"" first elementary elements
8, 8', 8"" second elementary elements
9, 10, 11 center points of the circular surfaces
12 magnets, pins
13, 14, 15 circular surfaces
16 disk
17 bores, openings
18 axis member
19 center point of the disk
20 plastic ring
21 combination element
22 combination element
A, B, C center points of the circular surfaces
F1, . . . , F5 circular surfaces
F1"", . . . , F9"" circular surfaces
k1, . . . , k8 center points of the circular surfaces F1, . . . , F5

What is claimed is:

1. A strategy game having a playing surface (1), wherein the playing surface (1) has a plurality of mutually overlapping circular surfaces (F1, F2, F3, F4, F5, F6, F7) each of the same respective radius R, and playing elements (7, 8, 21, 22) which are respectively arranged on at least one of the circular surfaces (F1, F2, F3, F4, F5, F6, F7), and wherein all playing elements (7, 8, 21, 22), which are disposed on any circular surface (F1, F2, F3, F4, F5, F6, F7) belonging completely to the playing surface, are rotatable jointly about the respective center point of the circle, and wherein the strategy game has at least one playing element which, on a side remote from the playing surface that has at least one entrainment element serving for mechanical engagement and movement of the playing elements with respect to the playing surface, and wherein the strategy game has a circular disk (16) with an axis member through the center point of the disk, wherein the axis member is so designed that the axis member engages releasably into a hole in the center point of one of the circular surfaces of the playing surface (1) so that the disk is rotatable about the center point of the circle and wherein the disk has second entrainment elements which are of complementary configuration to the entrainment elements of the playing elements and come into engagement therewith so that the playing elements which lie on the circular surface are rotatable by means of the disk with respect to the playing surface.

2. A strategy game as set forth in claim 1 wherein it has at least one of the following playing elements:

a first elementary element (7) which is movable with respect to the playing surface and whose base surface is substantially defined by two mutually intersecting circular arc portions of identical radius R and the center point spacing of which is so selected that the intersection points of the circles coincide with adjacent corners of an even-numbered, regular N-gon, the corners of which lie on one of the cycles, wherein the base surface forms the intersection quantity of the two circles, a second elementary element (8) which is movable with respect to the playing surface (1) and the outsides of which are formed by portions of at least three mutually touching or mutually intersecting circles and the base surface of which lies outside said circles, and a flat combination element which is movable with respect to the playing surface (1) and the base surface of which is formed from the base surfaces of at least one first and at least one second elementary element.

3. A strategy game as set forth in claim 2 wherein the first elementary element has exclusively convex outsides and the second elementary element has exclusively concave outsides.

4. A strategy game as set forth in claim 2 wherein the first elementary element has precisely two convex outsides and the second elementary element has 3, 4 or 6 concave outsides.

5. A strategy game as set forth in claim 1 wherein it has at least one of the following playing elements:

a first elementary element (7) which is movable with respect to the playing surface and whose base surface is defined substantially by two mutually intersecting circular arc portions of identical radius R and whose center point spacing is $\sqrt{3}$ R, a second elementary element (8) which is movable with respect to the playing surface (1) and whose base surface is defined substantially by three mutually intersecting, mutually touching circular arc portions of identical radius R which are curved towards the center point of the elementary element and whose center point spacing is 2R, and a flat combination element which is movable with respect to the playing surface (1) and whose base surface is formed from the base surfaces of at least one first and at least one second elementary element.

6. A strategy game as set forth in claim 2 wherein each playing element which is disposed completely in the overlap region of two circular surfaces (F1, F2, F3, F4, F5, F6, F7) is rotatable alternatively and selectably about the center point of the first circular surface or about the center point of the second circular surface of a radius R.

7. A strategy game as set forth in claim 2 wherein the center points of a first and a second circular surface are at a spacing from each other substantially equal to the radius R.

8. A strategy game as set forth in claim 2 wherein the center points of a first and a second circular surface are at a spacing from each other substantially equal to $\sqrt{3}\cdot R$.

9. A strategy game as set forth in claim 2 wherein the circle center points and the corners of the playing elements (7, 8), that are formed by intersection lines of overlapping circles, are disposed on an equilateral triangular lattice whose side length is equal to the radius R.

10. A strategy game as set forth in claim 2 wherein the elementary elements (7, 8) and combination elements disposed on one of the circular surfaces are respectively rotatable through $$\frac{\pi}{3}(=60^\circ)$$

or an integral multiple thereof about the respective center point of a circular surface.

11. A strategy game as set forth in claim 2 wherein the playing surface (1) and at least a part of the playing elements (7, 8) have retaining elements or ferromagnetic elements (12) which releasably fix the respective playing elements (7, 8) at predetermined positions of the playing surface, wherein retaining elements or the magnetic or ferromagnetic elements are arranged in a predetermined spacing raster grid on circles around the circle center points in such a way that the elementary elements or combination elements are rotatable alternatively and selectably about the center points of a first or a second circle, wherein the magnetic or ferromagnetic elements of the rotated playing elements again coincide with corresponding elements of the playing surface, which are arranged in the raster grid.

12. A strategy game as set forth in claim 1 wherein the playing surface has at least one part-circular guide for the playing elements.

13. A strategy game as set forth in claim 1 wherein the playing surface is a flat surface.

14. A strategy game as set forth in claim 1 wherein the playing surface is a curved surface.

15. A strategy game as set forth in claim 1 wherein a cover comprising a transparent material is provided over the playing elements.

16. A strategy game as set forth in claim 1 wherein the playing surface has at least one part-circular guide of a radius R for the playing elements.

17. A strategy game as set forth in claim 1 wherein the playing surface is a surface of a sphere.

* * * * *